United States Patent [19]

Sargent

[11] Patent Number: 4,785,484

[45] Date of Patent: Nov. 22, 1988

[54] CONTROL VALVE

[75] Inventor: Ronald J. Sargent, Escondido, Calif.

[73] Assignee: Alopex Industries, Inc., San Marcos, Calif.

[21] Appl. No.: 932,085

[22] Filed: Nov. 18, 1986

[51] Int. Cl.[4] ..... A61H 33/02

[52] U.S. Cl. ..... 4/542; 137/202; 137/800

[58] Field of Search ..... 4/541–544; 251/304, 299; 137/202, 800; 128/66

[56] References Cited

U.S. PATENT DOCUMENTS

| | | | |
|---|---|---|---|
| 3,057,115 | 10/1962 | Bilanin | 137/202 |
| 4,420,846 | 12/1983 | Bonner | 4/542 |
| 4,525,881 | 7/1985 | Higginbotham | 4/542 |
| 4,577,353 | 3/1986 | Viegener | 4/544 |
| 4,579,140 | 4/1906 | Sekine | 137/202 |
| 4,592,100 | 6/1986 | Robertson et al. | 4/542 |
| 4,637,080 | 1/1987 | Hutchinson | 4/541 |

*Primary Examiner*—Henry J. Recla
*Assistant Examiner*—Linda J. Sholl

[57] ABSTRACT

A hydrotherapy spa having a water jet into which air is aspirated through a conduit and a control valve for varying the effective flow area to the conduit from space inside the spa. The control valve comprises two generally cylindrical valve body members fitted together and defining an inlet passage extending outwardly between the two, and an outlet passage extending inwardly through the inner member and containing a ball check valve for preventing a reverse fluid flow. A cup-shaped cap is snap-fitted on the outer end portion of the valve body and formed with a closure member on its underside for variably opening arcuate ports in the outer end of the body variably connecting the inlet and outlet passages through these ports.

24 Claims, 2 Drawing Sheets

CONTROL VALVE

BACKGROUND OF THE INVENTION

This invention relates to the control of air flow and has particular reference to a valve that is mountable in a wall of a hydrotherapy spa or the like with an actuator that is accessible from the outer side of the wall and operable to control a flow of air from inside the wall to a hydrotherapy jet of the spa.

Control valves of this general type are known and used in hydrotherapy systems to control the amount of air that is introduced into a jet stream of fluid issuing from a jet into a spa, from no flow to a relatively high rate of flow. The air typically is drawn into the jet through a conduit that is open to the outside atmosphere, and the control valve is interposed in the conduit, between the jet and the atmosphere, to vary the effective flow area of the conduit and thereby vary the volume of air that is drawn into the jet stream.

An example of such a hydrotherapy system is shown in U.S. Pat. No. 4,592,100 wherein a control valve is recessed into the rim of a spa with a rotary control knob accessible from the outside and operable to move an inwardly extending valve member back and forth between open and closed positions. Air is drawn into the jet stream through the control valve from inside the wall, and a flexible check valve is provided to prevent back flow of fluid through the control valve.

This invention constitutes an improvement in this general type of control valve for performing the same basic functions but with a significantly different structure and improved operation.

SUMMARY OF THE INVENTION

The improved control valve of the present invention is simplified in construction and assembly and, at the same time, is relatively quiet in operation, leak-proof and conveniently adjustable for full and effective regulation of the rate of the flow, and compact and unobtrusive when mounted in the wall of a spa. For these purposes, the improved control valve has a valve body that is mounted in the spa wall and an actuator that is located outside the wall for convenient access, with port means in the actuator for varying the effective area of communication between an inlet passage that carries air outwardly from inside the wall to the actuator and an outlet passage that extends back inwardly through the wall for connection to a hydrotherapy jet.

The preferred actuator is a flat, cup-shaped cap that is fitted rotatably over the outer end portion of the valve body, with a resilient skirt that is snap-fitted over the valve body to provide sealing pressure between the port means on the cap and on the end of the valve body. The preferred valve body construction comprises two tubular body members that are fitted together to define an axial inlet passage in one or more spaces between the members and to define the outlet passage through the inner member. The inner tubular member preferably contains a check valve for blocking outward fluid flow through the outlet passage, in the form of a movable ball normally held in an "open" position but movable outwardly into a "closed" position in a port across the outlet passage, conveniently formed in the outer end portion of the outer body member.

The invention also resides in the detailed aspects of the configurations of the valve body members and the actuator cap, as will become apparent from the following detailed description, taken in conjunction with the accompanying drawings.

DETAILED DESCRIPTION

Figure 1:
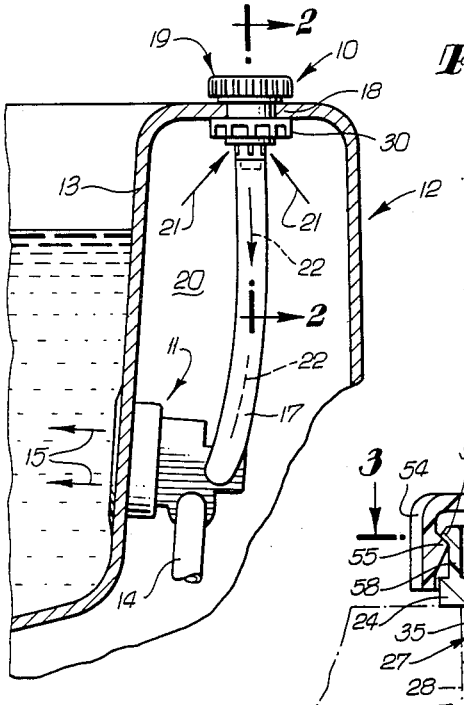
FIG. 1 is a fragmentary cross-sectional view taken through one side of an illustrative hydrotherapy spa equipped with an air control valve embodying the novel features of the present invention.

As shown in the drawings for purposes of illustration, the invention is embodied in a valve, indicated generally by the reference number 10, for establishing and controlling a flow of air to a hydrotherapy jet 11 in a spa 12 (FIG. 1), only a portion of which is shown in order to show a representative use of the control valve. The illustrative hydrotherapy jet is mounted in a sidewall 13 of the spa, below the level of the water therein, to receive a flow of water under pressure through a conduit 14 inside the spa and discharge the water into the spa in a jet stream, as indicated by the arrows 15.

The action of the hydrotherapy jet 11 may be enhanced by introducing a flow of air to the jet stream 15 through the control valve 10 and a conduit 17 which extends from the valve to the jet. The conduit 17 is exposed at one end to the flow of water through the jet and at the other end to air in the atmosphere, through the control valve when it is open, and this results in the drawing or "aspiration" of air into the jet stream issuing from the jet. When the control valve is closed, no air flow can occur, and varying rates of flow of air can be provided by adjusting the valve to vary the effective flow area to the conduit 17.

As can be seen in FIG. 1, the control valve 10 is shown as mounted in a wall 18 of the spa 12 that constitutes the upper edge of the rim of the spa, and has an actuator 19 that is accessible from outside the spa for adjustment of the air flow to the jet 11. To isolate the rushing noise of the air flow as much as possible from occupants of the spa, the valve is designed to establish communication between the conduit 17 and the space 20 within the rim of the spa, inside the walls 13 and 18, as indicated by the arrows 21 in FIG. 1. The air then flows from the valve through the conduit 17, as indicated by the arrows 22, to the jet stream 15. This general overall arrangement is conventional, as shown in the aforesaid patent.

In accordance with the present invention, the control valve 10 has a valve body that defines an air inlet passage 23 (see FIGS. 2 and 3) extending outwardly from inside the spa wall 18 to the actuator 19, which herein is a flat, cup-shaped cap that is rotatably mounted on the outer end portion 24 of the valve body, and also defines an air outlet passage 25 extending inwardly from the valve actuator for connection to the air conduit 17. Inside the valve actuator on the outer end of the valve body and in the cap, are valve ports which variably connect the inlet and outlet passages to establish the air flow to the jet 11 and vary that flow in accordance with the angular position of the cap on the valve body.

More specifically, the valve body comprises an outer tubular member 27, preferably a generally cylindrical plastic molding, fitted in and extending through an opening 28 in the spa wall 18 and having an outer end portion 24 of circular cross-sectional shape that is larger than the opening, and an inner end portion 29 that projects inwardly beyond the wall. A nut 30 is threaded onto the inner end portion and tightened against the wall 18, thereby clamping the outer end portion against the outer side of the wall and sealing the opening.

Figure 4:
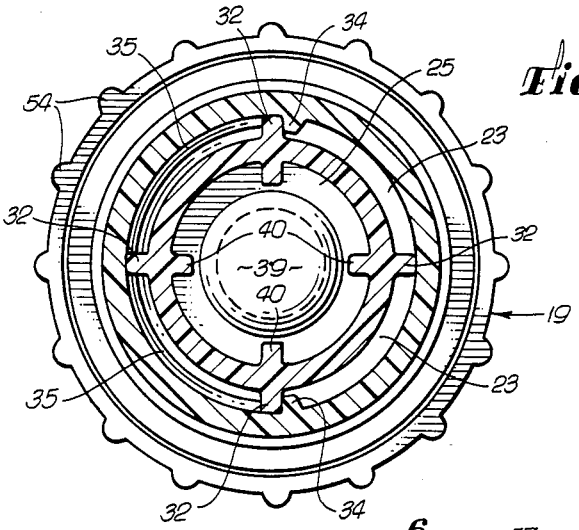
FIG. 4 is a cross-sectional view taken along line 4—4 of FIG. 2.

The passages 23 and 25 are defined in the valve body by a second, inner tubular member, indicated generally by the reference number 31, that is fitted inside the first member and shaped to form the inlet passage 23 between the two valve body members. As can be seen in FIG. 4, the inner member also is generally cylindrical in shape and has a smaller outside diameter than the inside diameter of the outer member, and has a plurality of longitudinal ribs 32, herein four, which serve to space the two members apart. Opposed ribs 34 on the inside of the outer member prevent relative rotation between the members.

This configuration forms an annular gap between the members, divided by the ribs 32 into four segments which extend axially or longitudinally of the valve body from its inner end portion, inside the wall, to the outer end portion. Two of the segments of the annular gap between the valve body members 27 and 31 are blocked off along one side on the valve body, herein adjacent their outer ends of the left-hand side of the control valve as viewed in FIGS. 2, 4 and 6. This is accomplished by resilient flaps 35 that are molded on the upper end of the inner body member, to interfit with an internal shoulder 37 on the inside of the outer member and seal the upper ends of these segments. This leaves open the two segments of the annular gap in the opposite side of the valve body, the right-hand side as viewed in the drawings, to form the inlet passage 23 of the control valve.

The outlet passage 25 of the control valve is the interior of the inner body member 31, which is simply an open passage extending from the outer end to the inner end. A check valve 38 is provided in the control valve to prevent back flow of fluid through this passage in the event of blockage of the hydrotherapy jet 11, or other unusual operating conditions creating a reverse flow of fluid in the air conduit. This check valve is formed by a ball 39, preferably of plastic, which is free to "float" in the outlet passage between a normal "open" position (FIG. 2) against the outer sides of four retaining abutments 40, herein shoulders on guide ribs 41 extending longitudinally of the outlet passage, and a "closed" position against a port 42 overlying the outlet passage at its outer end. This port is smaller than the ball, to be closed by the ball if any significant reverse flow occurs in the outlet passage. The ball is guided by the ribs 41 to be moved into closing engagement in the port 42, and normally is held by the ribs in a generally centered position in the passage for a free flow of air around the ball. It is preferred, but not essential, that the outlet passage is mounted in an upright position so that gravity holds the ball releasably in the open position.

Figure 2:
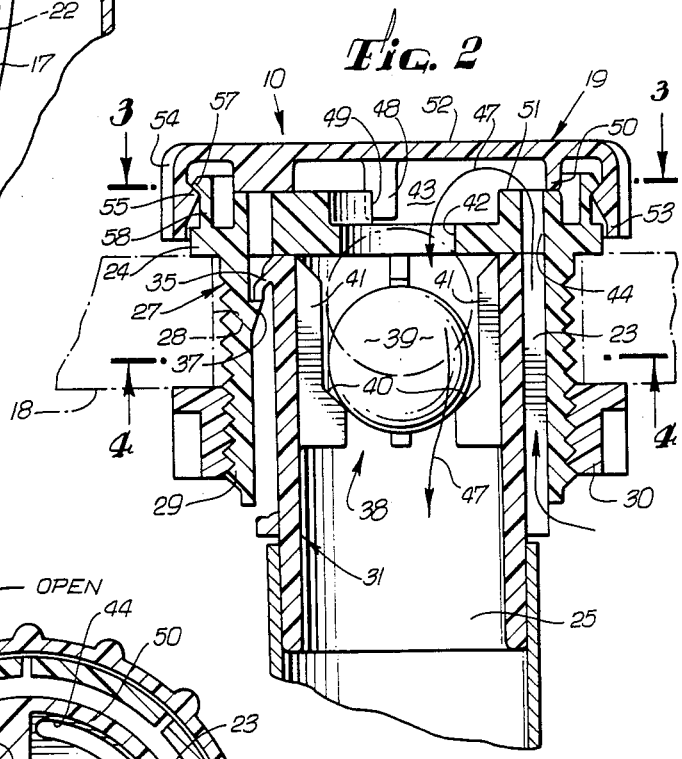
FIG. 2 is an enlarged fragmentary cross-sectional view taken substantially along line 2—2 of FIG. 1, showing the valve in an "open" condition.

As can be seen in FIG. 2, the port 42 is formed in the outer end portion of the outer valve member 27, and opens upwardly into a chamber 43 that is defined in the actuator cap 19. Two arcuate slots 44 and 45, each slightly less than ninety degrees in angular extent, form ports in the outer end portion of the outer valve body member over the outer ends of the two segments forming the air inlet passage 23.

Figure 3:
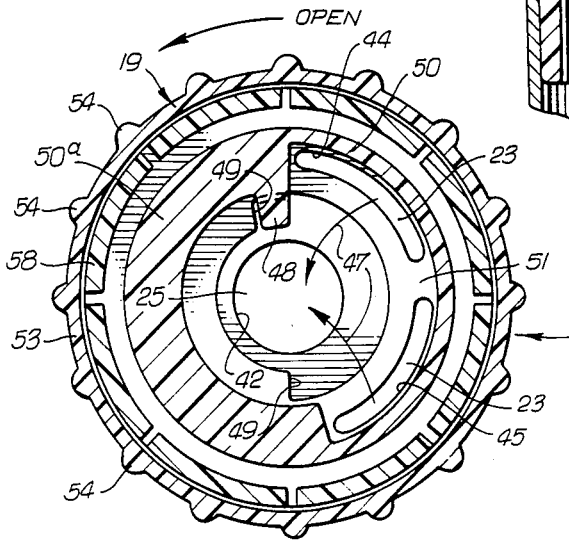
FIG. 3 is a cross-sectional view taken along FIG. 3—3 of FIG. 2.
Figure 5:
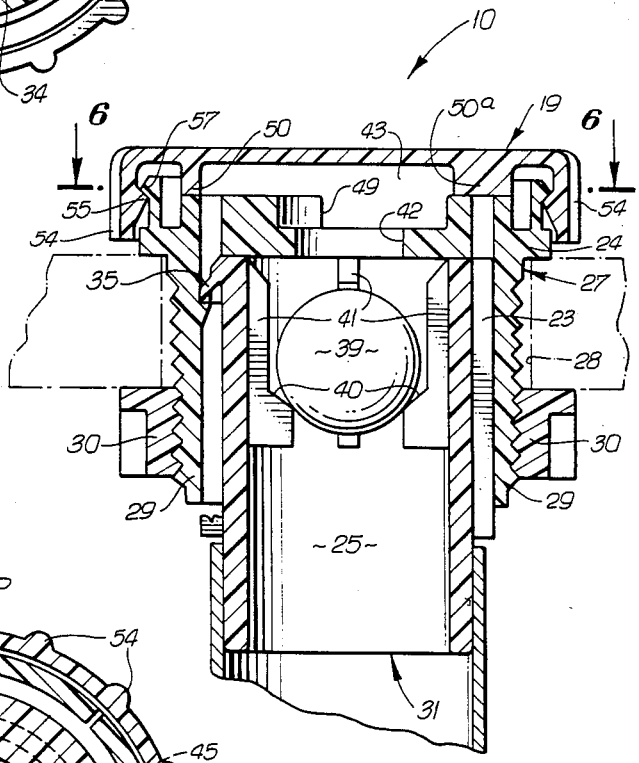
FIG. 5 is a view similar to FIG. 2 with parts in moved positions placing the valve in a "closed" condition.
Figure 6:
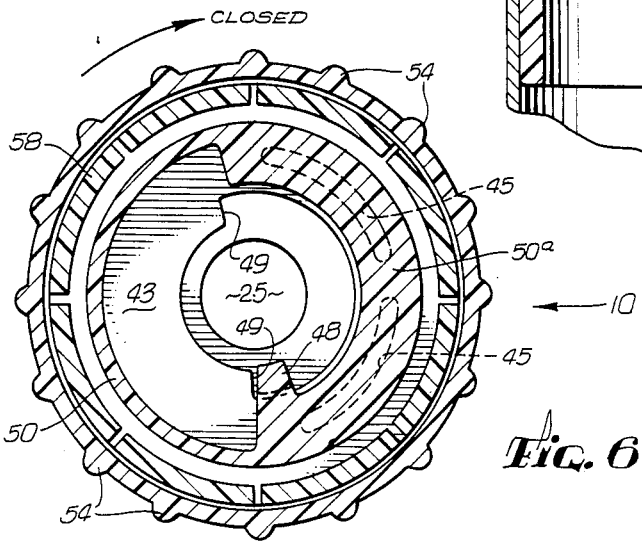
FIG. 6 is a cross-sectional view taken along line 6—6 of FIG. 5.

Thus, when the control valve is open as in FIGS. 2 and 3, the inlet and outlet passages 23 and 25 communicate through the slots 44 and 45 and through the chamber 43, as shown by the arrows 47. When the valve is closed as shown in FIGS. 5 and 6, the slots forming the end of the inlet passage 23 are blocked by the actuator cap 19, so that no appreciable air flow can occur through the valve.

More specifically, the underside of the cap 19 and the outer end of the outer valve body member 27 are designed to open and close the valve, and vary the extent of the opening, upon turning of the cap between two angularly spaced positions. These positions herein are approximately one hundred and eighty degrees (one-half turn) apart, and are determined by a detent in the form of a depending finger 48 on the underside of the cap and two angularly spaced stops 49 in the path followed by the finger during turning of the cap. These stops block the finger and thus limit the turning of the cap.

Formed on the underside of the cap 19 is an internal valve head which extends downwardly toward and engages the outer end of the outer valve body member. This head has a full circular rim 50, as shown in FIG. 3, with a semi-circular open space on one side, the right hand side in FIGS. 2 and 3, forming the chamber 43 for connecting the inlet and outlet passages. On the other one-half of the valve head, the rim 50 is thickened at $50^a$ to provide a closure member inside the rim, for overlying the slots 44 and 45 at the outer ends of the two segments of the outlet passage when the cap is turned one hundred and eighty degrees to the closed position (see FIGS. 5 and 6). The thickened portion $50^a$ is approximately one hundred and eighty degrees in angular extent.

In the closed position, the closure member $50^a$ bears against the outer end of the outer valve body member 27, in the area indicated by the reference number 51, and seals off the slots, disconnecting the inlet passage 23 from the chamber 43, which then overlies the closed portion of the outer end of the outer valve member.

It will be seen that the closure member $50^a$ will vary the effective flow area through the valve in turning from the open position (FIGS. 2 and 3) to the closed position (FIGS. 5 and 6) by progressively covering the two arcuate slots 44 and 45. Simlarly, during reverse turning, these slots are progressively uncovered to increase the flow area. This construction of the control valve makes it possible to obtain the precise opening and closing action that is desired by shaping the two slots.

The external configuration of the control valve is important, both for aesthetic reasons and because of the possibility of inadvertent body contact during use. In this instance, the exposed portion of the valve is quite compact and has a very low profile so as to be both visually and functionally unobtrusive.

As can be seen in FIG. 2, the cap 19 has a flat top 52 with a depending skirt 53 that surrounds the upper end portion of the valve body and terminates close to the spa wall 18. The skirt preferably has ribs 54 facilitating gripping, and the top of the cap preferably has markings (not shown) for indicating the direction of turning for opening and closing.

On the radially inner side of the skirt 53 is an internal rib 55 (FIGS. 2 and 4), preferably with inclined, wedge-like sides for interfitting with an external rib 57 around the outer end of the valve body, this rib also having inclined sides. With this arrangement, and with a skirt composed of resiliently flexible material, the cap 19 may be snap-fitted onto the valve body and held tightly against the outer end thereof by the interaction of the interfitting rigs for a simple and effective seal. The upstanding wall 58 of the valve body carrying the rib 57 may be interrupted as shown in FIGS. 3 and 6 and composed of resiliently flexible material to contribute to the spring action.

While materials of various kinds may be used, the presently preferred materials are ABS plastic for the ball retainer, the nut and the cap; polypropylene for the ball, and acetal for the valve body. Dimensions can be varied according to preference, and for use with standard spa equipment, such as one-inch and one and one-half inch conduit.

From the foregoing, it will be evident that the present invention provides a novel, relatively simple and very effective control valve for use in hydrotherapy spas and the like, to establish and control a flow of air from an inside space with an actuator that is conveniently accessible from the outside. It also will be evident that, while a preferred embodiment has been illustrated and described, various modifications and changes may be made without departing from the spirit and scope of the invention.

I claim as my invention:

1. A control valve for use in a spa having a wall with inner and outer sides and an opening through said wall, comprising:

a first tubular valve body member having inner and outer end portions and mountable in said opening with said outer end portion outside said wall and said inner end portion inside said wall, said outer end portion being larger than said opening and bearing against the outer side of said wall;

a nut threaded onto said inner end portion to be tightened inside said wall and clamp said outer end portion against said outer side to secure said valve body in said opening;

a second tubular valve body member disposed inside said first valve member and having an open interior defining an outlet passage extending inwardly through said valve from adjacent said outer end portion;

said first and second valve body members having means on the adjacent sides thereof defining an inlet passage in said valve extending from the inner end portion of said first member to said outer end portion thereof;

a cup-shaped cap fitted over said outer end portion and rotatably mounted thereon;

detent means in said cap and on said outer end portion for limiting rotation of said cap to a preselected angular range;

first and second port means in said cap and on said outer end portion, respectively, for establishing communication between said inlet and outlet passages as said cap is turned from one end of said range toward the other end and progressively increasing the area of such communication to an "open" position during such turning, and for progressively decreasing the area of such communication to a "closed" position as the cap is turned in the opposite direction toward said one end of said range, whereby the position of said cap determines the effective flow area through said inlet and outlet passages for the aspiration of air through said control valve;

and a one-way valve permitting inward fluid flow through said outlet passage and preventing outward flow therein, comprising a valve port in said outer end portion overlying the interior of said second valve member, a valve ball loosely disposed in said interior and movable into closing relation with said valve port to block outward fluid flow through said outlet passage, and a ball retainer spaced inwardly from said valve port to limit movement of said ball away from the valve port.

2. A control valve for use in a spa as defined in claim 1 wherein said valve members are substantially cylindrical in shape and said second valve member is substantially smaller in outside diameter than the interior of said first valve member and has angularly spaced longitudinal ribs bearing against said first valve member to space said members apart and define a plurality of spaces around said members, said inlet passage being formed by at least one of said spaces between said members and said ribs.

3. A control valve for use in a spa as defined in claim 2 wherein said flow passage comprises two of said spaces, and further including means for blocking flow through the remainder of said spaces.

4. A control valve for use in a spa as defined in claim 2 wherein said second port means are on the outer end of said first valve member and communicate with said outlet passage at the outer end of said second valve member and open axially outwardly toward said cap, said first port means on said cap being positioned to overlie said second port means and move across said outer end portion during turning of said cap.

5. A control valve for use in a spa as defined in claim 4 wherein said first second port means are arcuate slots on said outer end of said first valve member.

6. A control valve for use in a spa as defined in claim 5 wherein said cap has a closure member overlying said outer end of said first valve member and movable across said slots to progressively block the same.

7. A control valve for use in a spa as defined in claim 1 wherein said cap has a skirt that extends around said outer end portion, and further including means on said skirt and said outer end portion for rotatably supporting said cap and urging the cap yieldably toward said outer end portion.

8. A control valve for use in a spa as defined in claim 7 wherein said skirt is resiliently flexible and said means for rotatably supporting said cap comprise interfitting ribs on said skirt and said outer end portion with wedge-shaped surfaces engageable with a snap fit and operable to urge said cap toward said outer end portion.

9. A control valve for use in a spa having a wall with inner and outer sides and an opening through said wall, comprising:

a valve body having inner and outer end portions and being mountable in said opening with said outer end portion outside said wall and said inner end portion extending through said wall;

means in said valve body defining an inlet passage having an inlet end on said inner end portion to be disposed inside said wall and an outlet end adjacent said outer end portion, and defining an outlet passage having an inlet end adjacent said outer end portion and an outlet end on said inner end portion to be disposed inside said wall;

a valve actuator rotatably mounted on said outer end portion to lie outside said wall and rotatable between first and second angularly spaced positions;

and port means on said valve actuator and said outer end portion for establishing and progressively increasing communication between said inlet and outlet passages as said valve actuator is turned from said first position toward said second position, and progressively reducing and then terminating such communication as the valve actuator is turned back toward said first position.

10. A control valve as defined in claim 9 wherein said valve body is a first, outer tubular member, and said means defining said passages includes a second, inner tubular member fitted tightly inside said first member and cooperating therewith to define said inlet passage between said members, said outlet passage being defined by the interior of said second member.

11. A control valve as defined in claim 10 further including a ball disposed in said interior of said second member, a ball retainer limiting inward movement of said ball in said outlet passage, and means defining a valve port spaced outwardly from said ball, said ball being movable into closing relation with said port to block outward fluid flow from said outlet passage.

12. A control valve as defined in claim 10 wherein said port-defining means is on said outer end portion of said valve body and forms the inlet end of said outlet passage.

13. A control valve as defined in claim 9 wherein said valve actuator is a cup-shaped cap having a skirt surrounding said outer end portion.

14. A control valve for use in a spa as defined in claim 9 wherein said cap carries a closure member overlying the outer end of said valve body, and movable along said outer end during turning of said cap, said port means on said outer end portion lying along the path of said closure member.

15. A control valve for use in a spa as defined in claim 14 further including means mounting said cap rotatably and releasably on said outer end portion and urging said cap toward the outer end of said valve body.

16. A control valve for use in a spa as defined in claim 10 wherein said members are generally cylindrical and said second member has an outside diameter substantially smaller than the interior of said first member, and a plurality of longitudinal ribs between said members holding said members in spaced relation.

17. A control valve for use in a spa having a wall with inner and outer sides, comprising:

a valve body having inner and outer end portions and being mountable in and extending through said wall with said outer end portion on said outer side and said inner end portion on said inner side;

means in said valve body defining an outwardly extending inlet passage having a inlet end on said inner end portion and an inwardly extending outlet passage having an outlet end on said inner end portion, said passages having opposite ends on said outer end portion;

a valve actuator mounted on said outer end portion to lie outside said wall and movable between first and second positions;

and port means in said valve actuator and said valve body for establishing and terminating communication between said opposite ends of said inlet and outlet passages as said valve actuator moves back and forth between said first position and said second position.

18. A control valve for use in a spa having a wall with inner and outer sides, comprising:

a valve body mountable in said wall and having an outer end portion outside said wall;

a cup-shaped cap having a skirt surrounding said outer end portion and rotatably mounted thereon;

a closure member in said cap movable along a predetermined path across the outer end of said body as said cap is rotated on said outer end portion; and port means on said outer end portion within said cap for communicating through said cap, said port means establishing a progressively increasing flow area through said valve as said cap is turned in one direction.

19. A control valve for use in a spa as defined in claim 18 wherein said port means include a central first port and at least one second port spaced outwardly from said first port and lying on the path of said valve member during turning of said cap, to be progressively blocked by said valve member.

20. A control valve for use in a spa as defined in claim 18 wherein said cap includes a skirt extending around said outer end portion, and further including means on said skirt and said outer end portion for holding said cap rotatably and releasably on said valve body and urging said cap and said closure member toward said valve body.

21. A control valve for use in a spa having a wall with inner and outer sides and an opening through said wall, a valve mountable in said opening and comprising:

a first tubular member sized to fit in and extend through said opening and having an outer end portion larger than the opening and an inner end portion for projecting inwardly beyond said wall, and a second tubular member fitted inside said first member and having an interior constituting an air outlet passage extending from outside said wall to the inside thereof and having an outer end opening outwardly through said outer end portion, said tubular members defining between them at least one air inlet passage extending longitudinally of said valve body from inside said wall to outside said wall and opening outwardly through said outer end portion;

means for securing said valve body in said wall;

a valve actuator rotatably mounted on said outer end portion; and valve means in said actuator and said outer end portion for establishing communication between said inlet and outlet air passages outside said wall and varying the area of such communication as said actuator is rotated on said outer end portion.

22. A control valve as defined in claim 21 wherein said actuator is a cup-shaped cap having a skirt that surrounds said outer end portion and an end wall overlying the outer end of said valve body, said valve means being formed on said outer end and on said end wall.

23. A control valve as defined in claim 22 further including a one-way flow control valve mounted in said second tubular valve member and operable to permit air flow inwardly through said air outlet passage and to block flow outwardly through said air outlet passage.

24. A control valve as defined in claim 23 wherein said one-way flow control valve is a ball check valve.

* * * * *